US010478883B2

(12) United States Patent
Naderer et al.

(10) Patent No.: US 10,478,883 B2
(45) Date of Patent: Nov. 19, 2019

(54) APPARATUS AND METHOD FOR ROBOTIC ROLLER HAMMING

(71) Applicant: FerRobotics Compliant Robot Technology GmbH, Linz (AT)

(72) Inventors: Ronald Naderer, Sankt Florian (AT); Paolo Ferrara, Kematen an der Krems (AT)

(73) Assignee: FerRobotics Complaint Robot Technology GmbH, Linz (AT)

( * ) Notice: Subject to any disclaimer, the term of this patent is extended or adjusted under 35 U.S.C. 154(b) by 351 days.

(21) Appl. No.: 14/940,504

(22) Filed: Nov. 13, 2015

(65) Prior Publication Data

US 2016/0136709 A1 May 19, 2016

(30) Foreign Application Priority Data

Nov. 14, 2014 (DE) ..... 10 2014 223 313

(51) Int. Cl.
*B21D 19/04* (2006.01)
*B21D 39/02* (2006.01)

(52) U.S. Cl.
CPC ..... *B21D 19/04* (2013.01); *B21D 39/023* (2013.01)

(58) Field of Classification Search
CPC ..... B21D 5/16; B21D 19/04; B21D 19/043; B21D 19/12; B21D 39/021; B21D 39/023; B21D 39/00; B21D 39/02; B21B 13/14; Y10T 29/49915
See application file for complete search history.

(56) References Cited

U.S. PATENT DOCUMENTS 1,486,736 A * 3/1924 Foster ..... B21D 1/10 72/101
1,602,832 A * 10/1926 O'Brien ..... B21D 19/043 72/179
2,160,336 A * 5/1939 Maxfield ..... B21D 39/02 29/243.5
2,308,432 A * 1/1943 Johnson ..... B21D 19/043 29/DIG. 66

(Continued)

FOREIGN PATENT DOCUMENTS

CN 101360573 A 2/2009
CN 103370151 A 10/2013

(Continued)

OTHER PUBLICATIONS

Translation, JP 8-164433 A, Jun. 1996.*

(Continued)

*Primary Examiner* — Edward T Tolan
(74) *Attorney, Agent, or Firm* — Murphy, Bilak & Homiller, PLLC

(57) ABSTRACT

A roller hemming apparatus for robot-supported roller hemming with a manipulator, as well as with a roller hemming apparatus, is described. The apparatus includes a frame, a first roller and a second roller which, when in operation, contact two opposite sides of a workpiece, and at least one first actuator mechanically coupled to the frame and to at least one of the first and the second rollers and controlled so that opposing process forces that are applied over the first and the second rollers and that lie approximately along one effective line of force are applied to the workpiece at opposite sides.

15 Claims, 3 Drawing Sheets

(56) References Cited

U.S. PATENT DOCUMENTS

| | | | | | |
|---|---|---|---|---|---|
| 2,982,331 | A * | 5/1961 | Bouner | B21D 19/00 | 72/178 |
| 3,015,293 | A * | 1/1962 | Parham | B21D 39/02 | 29/509 |
| 3,055,414 | A * | 9/1962 | Boldrini | B21D 19/043 | 72/101 |
| 3,324,696 | A * | 6/1967 | McDonald | B21D 19/00 | 72/101 |
| 3,662,699 | A * | 5/1972 | Horn | B21D 39/02 | 29/243.5 |
| 3,850,017 | A * | 11/1974 | Fencl | B21D 19/005 | 72/109 |
| 4,324,031 | A * | 4/1982 | Isenhoff | B21D 39/02 | 29/243.5 |
| 5,228,190 | A | 7/1993 | Sawa | | |
| 6,477,879 | B1 * | 11/2002 | Sawa | B21D 39/021 | 29/243.58 |
| 6,477,970 | B1 * | 11/2002 | Ayorinde | B63B 25/00 | 114/73 |
| 8,272,243 | B2 * | 9/2012 | Hasegawa | B21D 19/043 | 29/243.5 |
| 8,307,526 | B2 * | 11/2012 | Jang | B21D 39/021 | 29/243.58 |
| 2008/0250835 | A1 | 10/2008 | Hasegawa et al. | | |
| 2010/0154503 | A1 | 6/2010 | Hasegawa et al. | | |
| 2010/0263424 | A1 | 10/2010 | Madhavan et al. | | |
| 2010/0313621 | A1 * | 12/2010 | Kumagai | B21D 39/021 | 72/220 |
| 2011/0271728 | A1 * | 11/2011 | Vanimisetti | B21D 39/021 | 72/46 |
| 2014/0005831 | A1 | 1/2014 | Naderer et al. | | |
| 2014/0150514 | A1 * | 6/2014 | Wang | B21D 39/023 | 72/252.5 |

FOREIGN PATENT DOCUMENTS

| | | | | |
|---|---|---|---|---|
| DE | 10011854 | A1 | 9/2001 | |
| DE | 10111374 | A1 * | 9/2002 | B21D 19/12 |
| DE | 1724033 | A2 * | 9/2004 | B21D 19/04 |
| DE | 10341182 | A1 | 3/2005 | |
| DE | 102004008821 | A1 | 9/2005 | |
| DE | 112006001640 | B4 | 3/2011 | |
| DE | 102011002859 | A1 * | 7/2012 | B21D 19/04 |
| DE | 102011006679 | A1 | 9/2012 | |
| EP | 0577876 | A1 | 1/1994 | |
| EP | 1447155 | A1 | 8/2004 | |
| JP | H0760370 | A | 3/1995 | |
| JP | H07132327 | A | 5/1995 | |
| JP | 08-164433 | A * | 6/1996 | B21D 19/04 |
| JP | 2001062530 | A | 3/2001 | |
| JP | 2005014069 | A | 1/2005 | |
| JP | 2005349471 | A | 12/2005 | |
| JP | 2007152391 | A | 6/2007 | |
| JP | 2011240400 | A | 12/2011 | |
| JP | 5570871 | B2 | 8/2014 | |
| WO | 2005082560 | A1 | 9/2005 | |

OTHER PUBLICATIONS

Wulfsberg, Jens et al., "Kraftgeregeltes Rollfalzen: System und Sensoreinsatzstrategien", ZWF Sensortechnik, Carl Hanser Verlag, München, vol. 100, 2005, pp. 130-135.

* cited by examiner

APPARATUS AND METHOD FOR ROBOTIC ROLLER HAMMING

PRIORITY CLAIM

This application claims priority to German Patent Application No. 10 2014 223 313.5 filed on 14 Nov. 2014, the content of said application incorporated herein by reference in its entirety.

TECHNICAL FIELD

The invention relates to an apparatus and a method for robot-supported roller hemming.

BACKGROUND

Roller hemming is a demanding manufacturing process that, even in the age of robotic (robot-supported) industrial processes, can only be reliably implemented with high expenditures of time and costs. However, in many branches of industry, such as the automobile industry, roller hemming is urgently needed for sheet metal forming in serial production. In particular the set-up tasks that precede a stable roller hemming process are very time-consuming. Highly trained and experienced experts are required to adjust the apparatus to the relevant workpiece conditions. The tolerances for form, position and material must be compensated by values learned through experience. Only under such conditions can good results be expected at the end of the process. It is not presently possible to fully compensate for these influencing factors by only using a manipulator and depending on the specifics of the robot's position.

An article by Jens. P. Wulfsberg et al., "*Force-regulated Roller Hemming*" in: *Zeitschrift für wissenschaftlichen Fabrikbetrieb* (Journal for Economic Factory Operation), No. 3, 2005, pp. 130-135, describes a force-regulated roller hemming process. In the article, the demanding regulation of an industrial robot for roller hemming is described.

It is an object of the present invention to provide an improved apparatus and an improved method for roller hemming. Cost and time intensive adjustment work for the purpose of setting up a stabile roller hemming process, as well as the influences of the workpiece's position and geometry on the roller hemming process are to be reduced.

SUMMARY

The following describes an apparatus for robotic roller hemming. According to one example of the invention, the apparatus for robotic roller hemming includes a manipulator and a roller hemming apparatus. The roller hemming apparatus comprises a frame, as well as a first roller and a second roller which, when in operation, contact two opposite sides of the workpiece. The roller hemming apparatus further comprises at least one actuator, which is mechanically coupled to the frame and at least one of the two rollers in such a manner and which is controlled in such a manner that opposing process forces, approximately directed along one effective line of force, are applied over the rollers to the opposite sides of the workpiece, and whereby the two rollers are movable relative to the frame. Therefore, an incorrect positioning of the roller hemming apparatus relative to the workpiece can be compensated for by moving the rollers relatively to the frame.

The opposing process forces produced by the at least one first actuator may be of the same strength, so that at least one resulting force and/or one resulting torque produced by the actuator and applied to the workpiece over the rollers is close to zero. The roller hemming apparatus can be designed in such a manner that the process forces applied by the actuator can run orthogonally to a feed direction of a roller hemming apparatus.

The manipulator can be designed to move either the roller hemming apparatus or the workpiece along a desired predetermined contour. In accordance with one example, the manipulator moves the roller hemming apparatus along a joint of the workpiece. In accordance with another example, the manipulator moves the workpiece in such a manner that it is fed in between the rollers of the roller hemming apparatus.

The roller hemming apparatus may comprise a first and a second actuator. In this case, the first actuator operates between the frame and the first roller and the second actuator operates between the frame and the second roller. Both actuators thereby allow for a moving of both rollers along the effective line of force (primarily perpendicular to the feed direction of the manipulator's tool center point (TCP)).

In accordance with another example, the at least one actuator operates between both rollers, whereby the actuator and the two rollers are mounted on the frame to be moveable (in the first direction). The actuator and the two rollers may additionally be arranged on a base piece, which is mounted on the frame. The actuator and the rollers may be moveably secured on the frame, e.g. by means of a spring or a further actuator (for example, over the mentioned base piece).

The roller hemming apparatus may include a motor that is designed to drive at least one of the rollers. Whereby at least one of the rollers can be driven in such a manner that its rotation speed matches the path velocity of the manipulator.

The apparatus may comprise a control unit that is designed to control the at least one actuator in such a manner that the process forces produced by the actuator approximately correspond to a target force, whereby the controlled (with or without force feedback) process forces are applied primarily perpendicular to the respective surfaces of the workpiece.

Further, a method for the robot-supported roller hemming of a workpiece using a roller hemming apparatus is described, whereby the roller hemming apparatus comprises a frame, a first roller and a second roller, as well as at least one first actuator. The rollers, when in operation, contact two opposite sides of the workpiece and the at least one actuator is mechanically coupled to the frame and at least one of the two rollers. In accordance with one example of the invention, the method comprises moving the workpiece or the roller hemming apparatus along a desired contour with the aid of a manipulator, as well as controlling the at least one actuator in such a manner that opposing process forces over the two rollers, directed primarily perpendicular to a feed direction of the roller hemming apparatus and approximately lying along the effective line of force, are applied to opposite sides of the workpiece.

Those skilled in the art will recognize additional features and advantages upon reading the following detailed description, and upon viewing the accompanying drawings.

BRIEF DESCRIPTION OF THE DRAWINGS

The invention can be better understood with reference to the following description and drawings. The figures are not necessarily to scale and the invention is not limited to the aspects shown therein. Instead emphasis is placed on illustrating the underlying principles of the invention. In the figures, the same reference numerals designate the same or similar components, each having the same or similar meaning. In the drawings.

DETAILED DESCRIPTION

Roller hemming is understood as the joining of two sheets of metal or other material using instruments similar to a folding machine (originally known from book binderies). Similar to flanging, the two materials are joined by form lock (form fit). Hereby the metal sheets are not sharply bent, but are instead rolled into each other using instruments (tools). The advantage of this is that the surfaces are not damaged and no notch stress is introduced into the material. This technology originally came from plumbers and is used today, e.g., to join parts of sheet metal. In addition to form-locked connection, the materials are also force-locked (force fitted) together by friction (clamping).

Roller hemming is also used in car body construction, whereby the car body parts are joined using robotic (robot-guided) roller machines. Here, the outer edge of a visible metal sheet is formed around the corresponding, non-visible inner part in one or several steps. The edge of the visible metal sheet is thereby bent over a corresponding edge of the inner part to produce a form-locked connection. The connection can be sealed by injecting a sealing adhesive into the joint before the roller hemming process.

Figure 1:
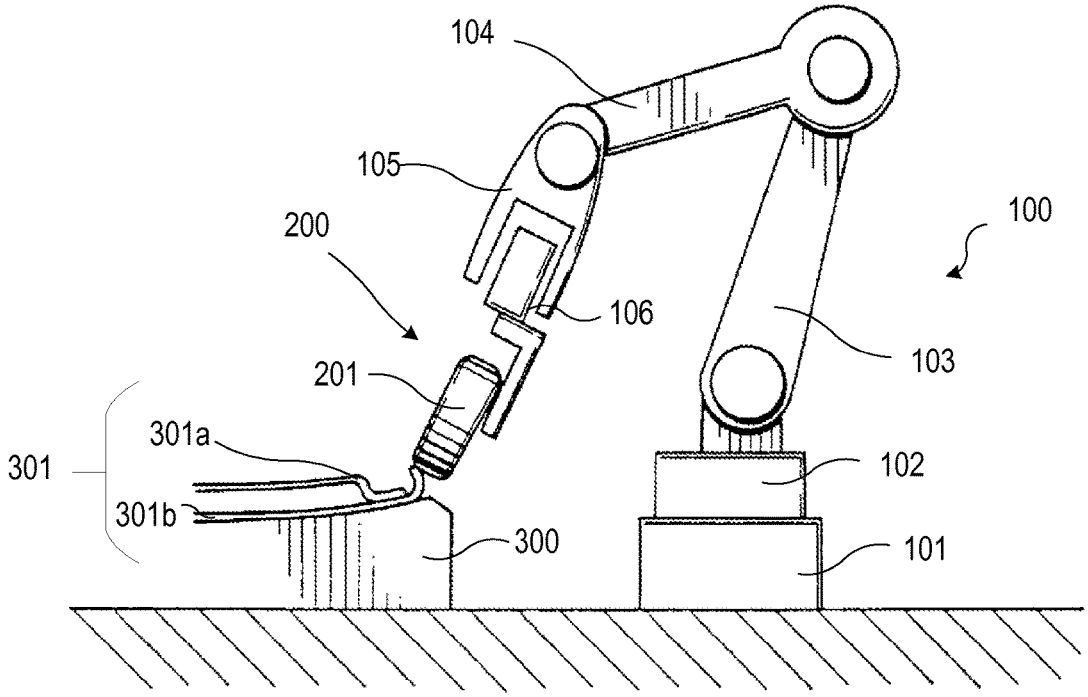
FIG. 1 shows a manipulator with an attached actuator for roller hemming on a corresponding base.

FIG. 1 shows a roller hemming process that is employed, for example, in the automobile industry for serial production. In the present example, the workpiece to be machined 301 is comprised, for example, of an (outer) metal sheet 301*b* and a (later internal) component 301*a* that are to be joined at the edge in a roller hemming process. Metal sheet 301*b* and the component 301*a* may be additionally joined by bonding. In order to produce the roller hemming connection, one edge of the metal sheet 301*b* is folded over a corresponding edge of the component 301*a*. In order to ensure that the fold of the metal sheet 301*b* runs evenly along the edge of the component 301*b*, it may be necessary to regulate the pressing force $F_N$ of the instrument (roller 201, see also FIG. 2). Industrial robots (so-called manipulators), however, are often position-controlled which—despite geometrically correct path planning—leads to defects in the flange (the fold) caused by unavoidable tolerances (and resulting fluctuations in the pressing force). If too little force is applied, the flange will not be closed tightly. If too much force is applied, the surface will exhibit visible deformations.

The mentioned problems (flange defects) can (at least partially) be resolved by, for example, attaching the instrument (roller 201*a*, 201*b*) to the manipulator 100 with a mechanically pre-tensioned spring. Minor deviations in the position can then be compensated for by deflecting the spring. If the spring characteristic curve is selected correctly, the pressing force $F_N$ will not be significantly altered. Instead of a spring, an additional actuator (i.e. linear actuator) may be employed to regulate the pressing force.

In the present example, which is shown in FIG. 1, the roller 201 is guided by a manipulator 100 over the joint of the workpiece 301. The manipulator 100 is, for example, a standard industrial robot with arm segments 103, 104, and 105. The first segment 103 may be rotatable and swivel-mounted on a base 102 that is rigidly connected to a pedestal 101 (foundation). The second (middle) arm segment 104 can be swiveled and is connected to the first arm segment 103. The third arm segment 105 is swivel-connected to the second arm segment 104 and carries the instrument on the so-called tool center point (TCP), in the present case roller 201. The instrument 201 is generally rotatable and swivel-connected (i.e. over a double-axis joint 106 included in the third arm segment 105) to the third arm segment 105. The manipulator 100 thus has six degrees of freedom and can hold the instrument 201 in any given position and orientation (referred to as "pose").

Figure 2:
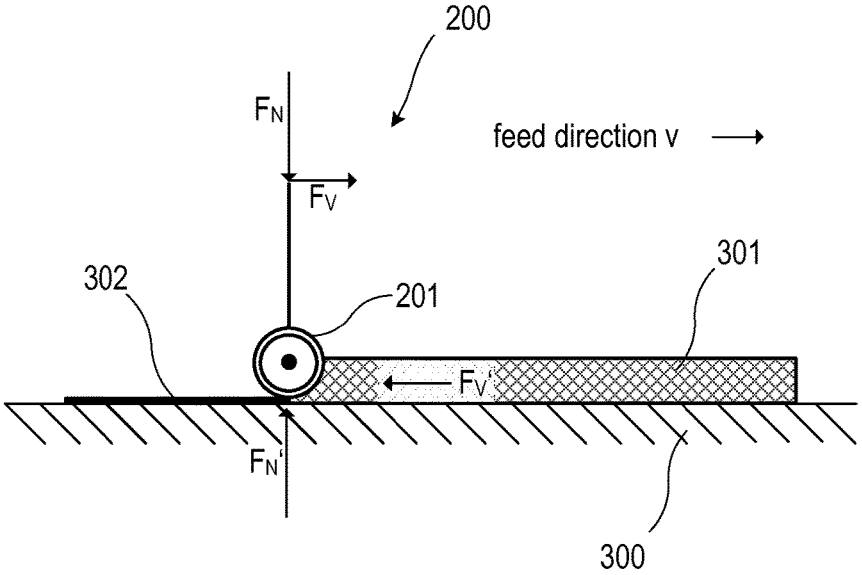
FIG. 2 shows the forces applied to the roller and the workpiece in an apparatus in accordance with FIG. 1.

During the roller hemming process, the workpiece 301 is arranged on a base 300, which absorbs the forces that arise during the roller hemming. Depending on the form of the flange connection, the base 300 can have a very complex form, which must be manufactured with a great degree of precision and requires considerable effort. In addition, it may be necessary to use mounting brackets to secure the workpiece 301 on the base and these themselves may create an obstruction for the movement of the manipulator 100. In FIG. 2 the forces that arise during the roller hemming process are schematically depicted. The forces $F_N$, $F_V$ applied to the workpiece 301 over the roller 201 are absorbed by the base 300. The pressing force $F_N$ (in the following text also referred to as process force $F_N$, $F_N'$) is applied perpendicular (at a right angle) to the feed direction v to the workpiece 301 and the feed force $F_V$ is applied in feed direction v. The respective counter-forces (reaction forces) that the base 300 applies to the workpiece 301 are designated as $F_N'$ and $F_V'$. In order to compensate for the form and position tolerances of the workpiece 301, the roller 201, as mentioned above, can be coupled, e.g., over a spring, to the TCP of the manipulator 100. Nevertheless, depending on the form of the workpiece 301, a complex base 300 is needed to absorb the forces that arise during the roller hemming.

Figure 3:
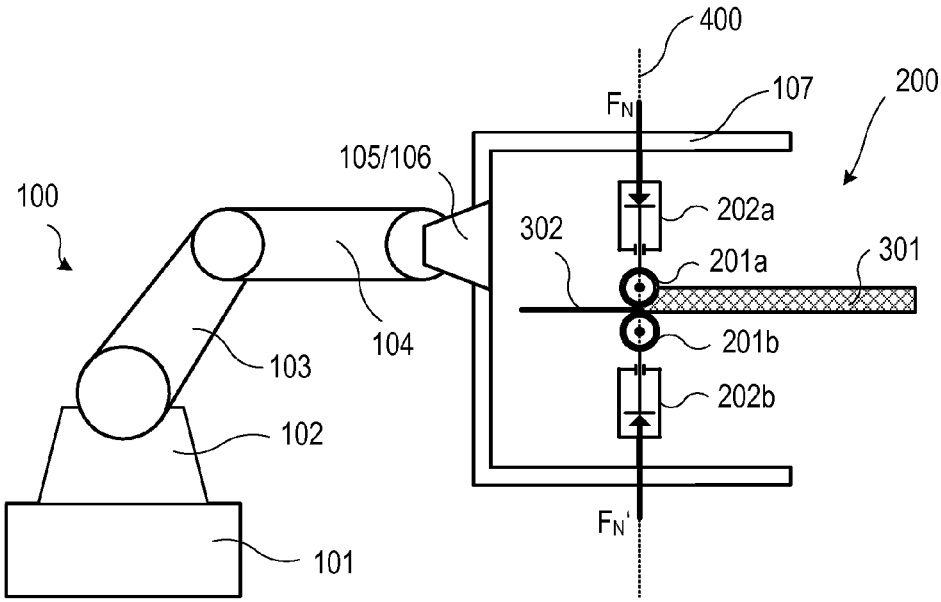
FIG. 3 shows a roller hemming apparatus guided by a manipulator in accordance with a first embodiment having two actuators and two rollers, positioned opposite each other, for the roller hemming of a workpiece.

The exemplary arrangement schematically depicted in FIG. 3 makes it possible to do without the above-mentioned complex base 300, as only the (relatively low) feed force $F_V$ need be absorbed by the workpiece 301 because the process forces $F_N$, $F_N'$ compensate each other. The construction of manipulator 100 in accordance with FIG. 3 is essentially the same as in the previous example (FIG. 1). Accordingly, the manipulator 100 comprises three arm segments 103, 104, and 105 (including the joint 106, cf. FIG. 1). The first segment 103 is rotatable and swivel-mounted on a base 102, which is rigidly connected to a pedestal 101 (foundation). The second (middle) arm segment 104 is swivel-connected to the first arm segment 103. The third arm segment 105 is swivel-connected to the second arm segment 104 and carries the instrument over the joint 106 on the so-called tool center point (TCP). In the present case, the instrument is not a simple roller, but rather a more complex roller hemming apparatus 200, which will be discussed in greater detail below.

In accordance with the shown embodiment, the roller hemming apparatus comprises a first roller 201*a* and a second roller 201*b*, which, when in operation, contact opposite sides of a workpiece 301. The roller hemming apparatus additionally comprises a frame 107, as well as at least one first actuator 202*a*, 202*b* that is mechanically coupled to the frame 107 and at least one of the two rollers 201*a*, 201*b*. The present example includes two actuators 202*a*, 202*b*, wherein each of the two actuators 202*a*, 202*b* mechanically couple one of each roller 201*a*, 201*b* to the frame 107. The at least one actuator (in the present example one and/or both actuators 202*a*, 202*b*) is (are) controlled in such a manner so that opposing process forces $F_N$, $F_N'$ (pressing forces) are applied to opposite sides of the workpiece 301 over the two rollers 201*a*, 201*b*. The magnitude of the process forces $F_N$, $F_N'$ can be regulated by controlling the actuators 202*a*, 202*b* accordingly. The net force $F_N+F_N'$ resulting from process forces, however, is close to zero (as $F_N'=-F_N$). Tolerances of the workpiece 301 and the path tolerances of the manipulator 100 are thereby fully compensated in the direction of the process forces $F_N$, $F_N'$ and neither the workpiece 301, nor the manipulator 100 is subject to a reactive force. The two rollers 201*a*, 201*b* may be "float" mounted on the manipulator 100 with the illustrated arrangement of the two actuators 202*a*, 202*b*. A float mounting can understood as a mounting that allows the rollers 201*a*, 201*b* to adapt to irregularities of the workpiece 301 while in operation. Irregularities can be understood, for example, as unevenness on the surface of the workpiece, as well as tolerances in form and position.

The illustration of FIG. 3 should only be regarded as a schematic drawing. In practice, the rollers 201*a*, 201*b* and the workpiece 301 may be positioned in the arrangement according to FIG. 3 in such a manner that the feed direction v during roller hemming is largely perpendicular to the drawing plane. The actuators 202*a*, 202*b* may be realized as linear actuators, for example, pneumatic cylinders or as piston-free pneumatic actuators (so-called bellow cylinders). A direct electromagnetic drive (i.e. a gearless electric drive) may also be considered (when less process force is required). The actuators 202*a*, 202*b* may be arranged opposite and primarily coaxially to each other (or at least in such a manner that the resulting force perpendicular to the drive direction v can be compensated), between the frame 107 and the rollers 201*a*, 201*b* (e.g., on two opposite cantilevers of the frame 107). Consequently, the process forces $F_N$ and $F_N'$ produced by the actuators 202*a*, 202*b* can lie approximately along one common effective line of force 400. The effective line of force 400 may be arranged orthogonally to the feed direction v. Thus, the process forces $F_N$ and $F_N'$ will be able to fully compensate each other. For this purpose, the actuators 202*a*, 202*b* may have a linear track (not shown) that enables the actuators 202*a*, 202*b* to execute such a movement along the line of force 400. When in operation, the workpiece 301 lies between the two rollers 201*a*, 201*b*, whereby the actuator 202*a* presses the roller 201*a* against the workpiece 301 from above (process force $F_N$), and the actuator 202*b* presses the roller 201*b* against the workpiece 301 from below (process force $F_N'$). The net force $F_N+F_N'$ is, as previously mentioned, zero. Because the actuators 202*a* and 202*b* operate approximately along one line, the actuators 202*a*, 202*b* apply no or only very little torque to the workpiece 301. Consequently, no irregularities in the workpiece 301 are able to apply back to the manipulator 100 any significant torque, and the accuracy and robustness of the roller hemming process with regard to irregularities in the position and/or geometry of the workpiece 301 can be improved. The finished, rolled flange is designated with the reference numeral 302.

Decoupled from the movement of the actuators 202*a*, 202*b*, the manipulator 100 can produce the drive (feed) necessary for the roller hemming process. The manipulator 100 moves the roller hemming apparatus position-controlled along a pre-determined trajectory, while the process forces $F_N$, $F_N'$ are regulated to a target value with the aid of the actuators 202*a*, 202*b*. Tolerances in the form and position of the workpiece 301, as well as path-planning inaccuracies relating to the trajectory, along which the roller hemming apparatus 200 is to run, can be compensated by the actuators 202*a*, 202*b*. The actuators 202*a*, 202*b* are controlled to press against the workpiece 301 with the pre-determined process forces $F_N$ and $F_N'$ without, however, applying any significant resistance to a uniform movement of the rollers 201*a*, 201*b* relatively to the frame 107 (at least within certain limits), as the forces $F_N$ and $F_N'$, as already mentioned, cancel each other. Thus the manipulator 100 is decoupled from these compensation movements.

Figure 4:
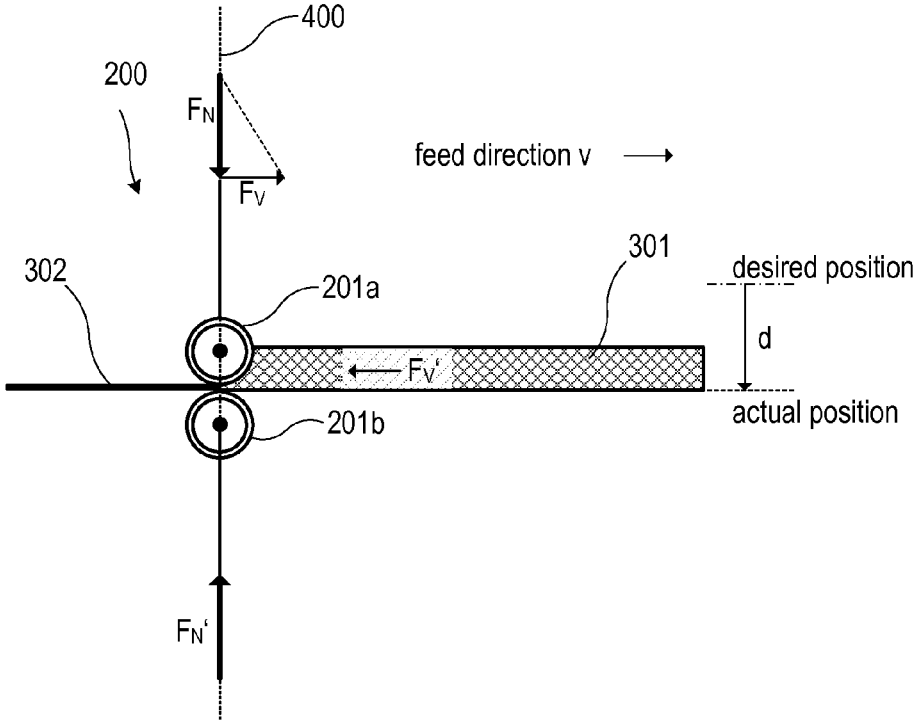
FIG. 4 shows the forces applied to the rollers and the workpiece in an apparatus according to FIG. 3.

In FIG. 4, the forces applied to the workpiece 301 during roller hemming in accordance with the arrangement of FIG. 3 are, once again, depicted in greater detail. As already mentioned, the regulated process forces $F_N$, $F_N'$ are of equal strength and are applied from opposite directions. With the aid of the manipulator 100, a feed force $F_V$ is produced that moves the roller hemming apparatus 200 across the workpiece 301. Only the feed force $F_V$ need be absorbed by the workpiece 301 (counterforce $F_V'$). As mentioned above, any deviation of the position d of the workpiece 301 from a desired position (relative to the frame 107) is compensated by a corresponding deflection of the actuators 202*a*, 202*b*. The distance d designates in this case the deviation of actual position of workpiece 301 from the theoretically desired position of workpiece 301 in the coordinate system of the roller hemming apparatus 200. This position deviation d can either be caused by inaccuracies in the positioning of the roller hemming apparatus (e.g., by inaccuracies in the path planning for the manipulator 100), by inaccuracies in the positioning of the workpiece 301, or by deviations in the form of the workpiece 301.

Figure 5:
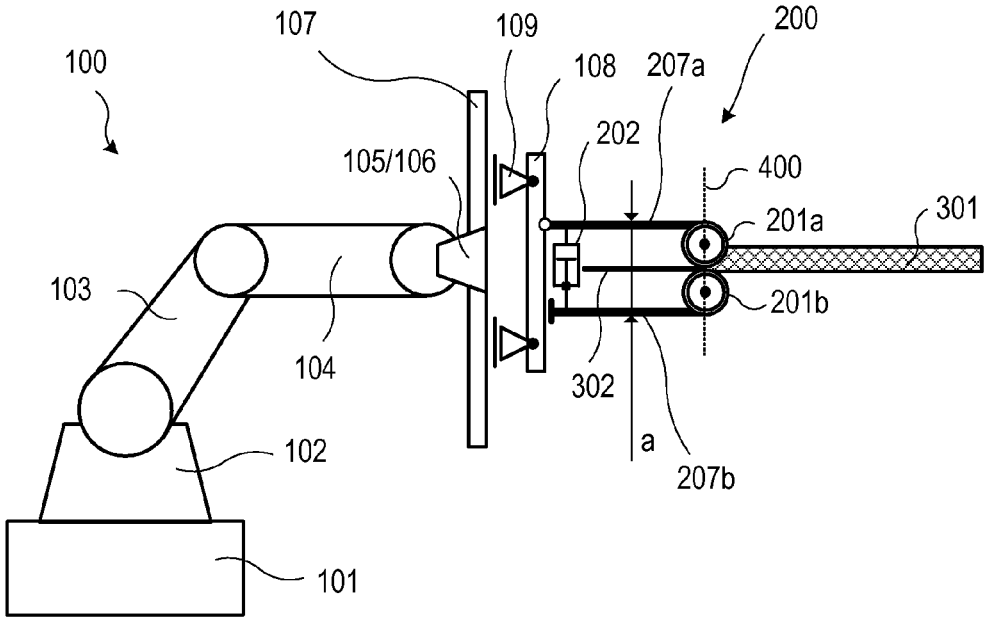
FIG. 5 shows a roller hemming apparatus guided by a manipulator in accordance with a second embodiment having an actuator and two rollers, positioned opposite each other, for the roller hemming of a workpiece.

FIG. 5 shows a further embodiment of a roller hemming apparatus 200 that can operate with only a single actuator 202. The manipulator 100 is set up essentially in the same manner as in the previous examples. Different from the example of FIG. 3, the actuator 202 does not operate between the frame 107 and the rollers 201*a*, 201*b*, but rather between the rollers 201*a*, 201*b*. Here the first roller 201*a* is unmovably mounted over a cantilever 207*a* on a base piece 108. The second roller 201*b* is also mounted on the base piece 108 over a cantilever 207*b* and by means of a linear track, so that the distance a between the rollers 201*a*, 201*b* is adjustable. The actuator 202 may be, as in the previous examples, a pneumatic cylinder, a piston-free pneumatic actuator (i.e. an air muscle or a bellow cylinder) or an electric direct drive. In order to compensate form and position tolerances of the workpiece 301 or inaccuracies in the path planning for the manipulator 100, the base piece 108 (together with the actuator 202 and the rollers 201*a*, 201*b*) is movably mounted on the frame 107 (e.g. with the aid of a linear track 109). The weight of the roller hemming apparatus itself can be compensated, if necessary, by means of (an active or passive) spring (not shown), allowing the base 108 to be suspended in one position on the frame 107.

Therefore, if there are deviations in the actual position of the workpiece 301 from the theoretically desired position, no errors in the process forces $F_N$, $F_N'$ occur. Instead of a passive spring, active components (i.e. an additional linear actuator) may be employed as a spring. In this respect, all components that function like a mechanical spring are to be understood as a spring. In the example shown in FIG. 5, the process forces $F_N$, $F_N'$ that are applied to the workpiece 301 by the rollers 201*a*, 201*b* operate approximately along a common effective line of force 400. Consequently, also in this example, the resulting force and/or the resulting torque applied to the workpiece 301 are close to zero.

Figure 6:
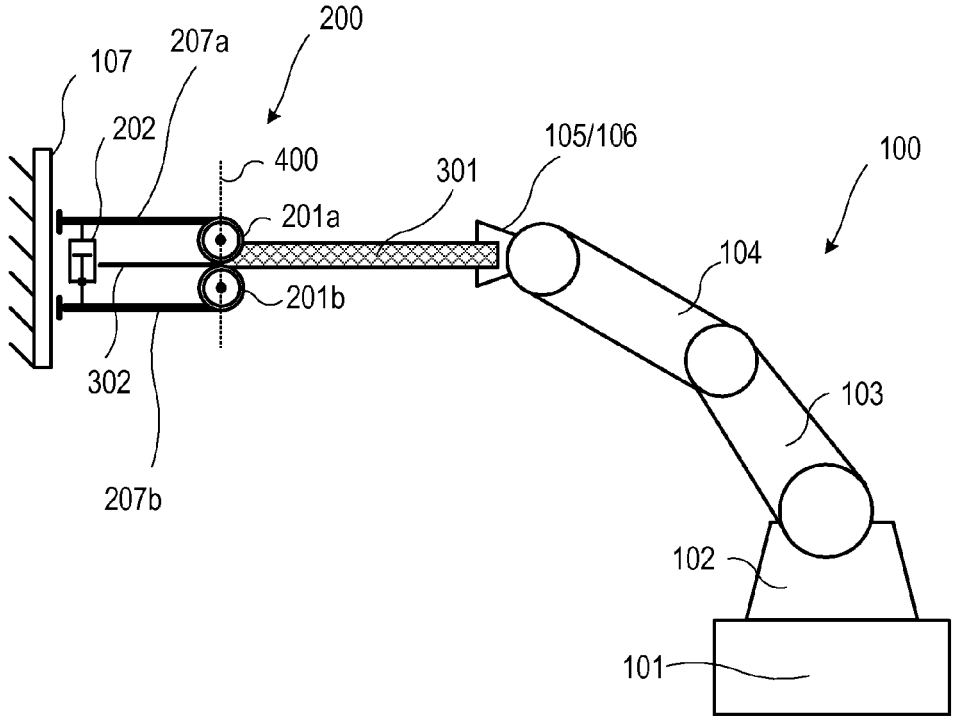
FIG. 6 shows a roller hemming apparatus in accordance with a further embodiment having an actuator and two rollers, positioned opposite each other, for the roller hemming of a workpiece guided by a manipulator.

In the previous examples, the roller hemming apparatus 200 was guided along a previously planned path along the joint of the workpiece 301 with the aid of a manipulator 100. However, the roller hemming apparatuses described here (FIGS. 3, 5 and 6) may also be rigidly mounted on a pedestal, in which case the manipulator 100 is employed to guide the workpiece 301 along its joint through the rollers 201*a*, 201*b* of the roller hemming apparatus so that, with the aid of the rollers 201*a*, 201*b*, the flange is closed. Such a situation is shown in FIG. 6. The manipulator 100 is largely assembled in the manner of the previous examples, with the difference that, not the roller hemming apparatus 200 is attached to the third arm segment 105 (including joint 106, cf. FIG. 1), but rather the workpiece 301 (e.g. with the aid of a gripper). The roller hemming apparatus 200 is constructed in a very similar manner as in the previous example (FIG. 5). In this example, the actuator operates between the rollers 201*a*, 201*b*. Both rollers 201*a* and 301*b* are movably mounted on the frame 107 over cantilevers 207*a* and 207*b*, respectively. With the aid of the actuator 202, the distance a between the rollers 201*a* and 201*b* may be influenced (and thus also the forces operating between the rollers 201*a* and 201*b*), not, however, the relative position of the rollers 201*a*, 201*b* to the frame 107. This relative position may vary depending on the form and position tolerances of the workpiece 301, as well as on inaccuracies in the planning of the path. One of the rollers (e.g. roller 201*b*) may be coupled to the frame 107 by means of a spring. Thus, largely the same effect is obtained as in the previous example (FIG. 5) with the spring between base piece 108 and frame 107.

In another possible embodiment the rollers 201*a*, 201*b* may be driven actively so that they rotate synchronously to the feed movement. The feed force and its counter force $F_V$, $F_V'$ would also be compensated in this manner They would then no longer need to be absorbed by the manipulator 100 and the base 300 and workpiece fixings may be omitted altogether. Here the speed of the rollers 201*a*, 201*b* is adjusted to the path velocity of the manipulator's 100 TCP. This means that the circumferential speed of the rollers 201*a*, 201*b* corresponds to the path velocity of the manipulator's 100 TCP.

Finally it should be noted that the rollers 201*a*, 201*b* may be made of metal (e.g. tool steel). In accordance with one embodiment, the running surface (along the rollers' circumference) may be made of or coated with a material, which is softer than the workpiece surface (e.g. a metals with lower hardness than tools steel or an elastomer). That is, the hardness of the running surface of the rollers 201*a*, 201*b* is less than the hardness of the workpiece surface. Using a "soft" running surface in at least one of the rollers 201*a*, 201*b* results in particles (e.g. dirt particles, metal chips, etc.) not being pressed into the workpiece surface.

While various embodiments of the invention have been described, it will be apparent to those of ordinary skill in the art that many more embodiments and implementations are possible within the scope of the invention. Accordingly, the invention is not to be restricted except in light of the attached claims and their equivalents. With regard to the various functions performed by the components or structures described above (assemblies, devices, circuits, systems, etc.), the terms (including a reference to a "means") used to describe such components are intended to correspond, unless otherwise indicated, to any component or structure that performs the specified function of the described component (i.e., that is functionally equivalent), even if not structurally equivalent to the disclosed structure that performs the function in the exemplary implementations of the invention illustrated herein.

With the above range of variations and applications in mind, it should be understood that the present invention is not limited by the foregoing description, nor is it limited by the accompanying drawings. Instead, the present invention is limited only by the following claims and their legal equivalents.

What is claimed is:

1. An apparatus for robotic roller hemming with a manipulator, and with a roller hemming apparatus that comprises:

a frame;

a first roller and a second roller, which, when in operation, contact opposite sides of a workpiece and are mounted movably relative to the frame;

at least one first actuator mechanically coupled to the frame and to at least one of the first and the second rollers and is controlled so that, over the first and the second rollers, opposing process forces lying approximately along one effective line of force are applied to the opposite sides of the workpiece, wherein the first and the second rollers are movable along the effective line of force by the at least one first actuator, wherein the first and the second rollers are mounted onto the frame so as to allow compensation of an incorrect positioning of the roller hemming apparatus relative to the workpiece by moving the first and the second rollers relative to the frame.

2. The apparatus of claim 1, wherein the opposing process forces produced by the at least one first actuator are of the same magnitude, so that at least a net process force and/or a net torque applied over the first and the second rollers to the workpiece by the at least one first actuator is approximately zero.

3. The apparatus of claim 1, wherein the manipulator is configured to move the roller hemming apparatus along a predetermined desired contour.

4. The apparatus of claim 1, wherein the roller hemming apparatus further comprises a second actuator, wherein the at least one first actuator operates between the frame and the first roller and the second actuator operates between the frame and the second roller, and wherein the at least one first actuator and the second actuator allow for a movement of the first and the second rollers along an effective line of force.

5. The apparatus of claim 1, wherein the at least one first actuator operates between the first and the second rollers, and wherein the at least one first actuator and the first and the second rollers are movably arranged on the frame.

6. The apparatus of claim 5, wherein the at least one first actuator and the first and the second rollers are arranged on a base piece that is guided along the frame.

7. The apparatus of claim 5, wherein the at least one first actuator and the first and the second rollers are movably mounted on the frame by means of a spring or a further actuator.

8. The apparatus of claim 1, further comprising a motor configured to drive at least one of the first and the second rollers.

9. The apparatus of claim 8, wherein the first roller is configured to be driven so that a rotational speed of the first roller is adjusted to a path velocity of the manipulator.

10. The apparatus of claim 1, further comprising a control unit configured to control the at least one first actuator so that the opposing process forces produced by the at least one first actuator approximately correspond to a target force magnitude, wherein controlled process forces are applied substantially perpendicular to respective surfaces of the workpiece.

11. The apparatus of claim 1, wherein the manipulator is configured to move the roller hemming apparatus along a joint of the workpiece.

12. The apparatus of claim 1, wherein the manipulator is configured to move the workpiece between the first and the second rollers.

13. The apparatus of claim 1, wherein the opposing process forces run orthogonally to a feed direction of the roller hemming apparatus.

14. The apparatus of claim 1, wherein at least one of the first and the second rollers has a running surface, which, during operation, is in contact with a workpiece surface and which has a hardness lower than the hardness of the workpiece surface.

15. A method of operating an apparatus for robot-controlled roller hemming of a workpiece with the aid of a roller hemming apparatus that comprises a frame, a first roller and a second roller which, when in operation, contact two opposite sides of the workpiece and which are mounted movably relative to the frame, and at least one first actuator mechanically coupled to the frame and to at least one of the first and the second rollers, the method comprising:

moving the workpiece or the roller hemming apparatus along a desired contour with the aid of a manipulator; and controlling the at least one first actuator so that opposing process forces that are applied primarily perpendicular to a feed direction of the roller hemming apparatus and lie approximately along one effective line of force are applied to opposite sides of the workpiece, moving the first and the second rollers along the effective line of force using the at least one first actuator, wherein the first and the second rollers are mounted onto the frame so as to allow compensation of an incorrect positioning of the roller hemming apparatus relative to the workpiece by moving the first and the second rollers relative to the frame.

* * * * *